US009371643B2

(12) United States Patent
Kallweit et al.

(10) Patent No.: US 9,371,643 B2
(45) Date of Patent: Jun. 21, 2016

(54) BUILDING FACADE WITH LOCK ELEMENT AND LOCK ELEMENT

(71) Applicants: Gerhard Kallweit, Bottrop (DE); Markus Schroder, Oberhausen (DE); Thomas Tielemann, Vreden (DE)

(72) Inventors: Gerhard Kallweit, Bottrop (DE); Markus Schroder, Oberhausen (DE); Thomas Tielemann, Vreden (DE)

(73) Assignees: Rockwool International A/S, Hedehusene (DK); Deutsche Rockwool Mineralwoll GmbH & Co. OHG, Gladbeck (DE)

( * ) Notice: Subject to any disclaimer, the term of this patent is extended or adjusted under 35 U.S.C. 154(b) by 0 days.

(21) Appl. No.: 14/341,459

(22) PCT Filed: Jan. 31, 2013

(86) PCT No.: PCT/EP2013/051866

§ 371 (c)(1),
(2) Date: Jul. 25, 2014

(87) PCT Pub. No.: WO2013/117479

PCT Pub. Date: Aug. 15, 2013

(65) Prior Publication Data

US 2015/0059260 A1 Mar. 5, 2015

(30) Foreign Application Priority Data

Feb. 8, 2012 (DE) ..... 20 2012 100 418 U
Apr. 5, 2012 (EP) ..... 12163364

(51) Int. Cl.
*E04B 1/00* (2006.01)
*E04C 1/00* (2006.01)
(Continued)

(52) U.S. Cl.
CPC . *E04B 1/941* (2013.01); *E04B 1/76* (2013.01); *E04B 2/30* (2013.01); *E04F 13/007* (2013.01);
(Continued)

(58) Field of Classification Search
CPC ..... E04B 1/941; E04B 1/76; E04B 2/30; E04B 1/947; E04B 2002/0273; E04F 13/007; E04F 13/0803; E04F 2290/045
See application file for complete search history.

(56) References Cited

U.S. PATENT DOCUMENTS 4,061,344 A * 12/1977 Bradley ..... E04B 1/947 174/151
4,323,620 A * 4/1982 Iwabuchi ..... B32B 15/14 220/62.15

(Continued)

FOREIGN PATENT DOCUMENTS

DE 4036865 A1 5/1992
DE 19859851 A1 12/2000

(Continued)

OTHER PUBLICATIONS

Translation of EP 0829593 provided by espacenet at: http://translationportal.epo.org/emtp/translate/?ACTION=description-retrieval&COUNTRY=EP&ENGINE=google&FORMAT=docdb&KIND=A1&LOCALE=en_EP&NUMBER=0829593&OPS=ops.epo.org/3.1&SRCLANG=de&TRGLANG=en.*

*Primary Examiner* — Brian Mattei
(74) *Attorney, Agent, or Firm* — John Wilson Jones; Jones & Smith, LLP

(57) ABSTRACT

A building facade consisting of a building wall, an insulating layer comprising insulating elements, having a surface and disposed on the building wall, a facade cladding which is disposed at a distance from the building wall and from the insulating layer to form a rearventilation gap between insulating layer and facade cladding and a lock element provided for fire protection, which is disposed between neighboring insulating elements of the insulating layer. In order to further develop a building facade in such a manner that it can be manufactured simply and therefore cost-effectively without additional structural elements being provided, the invention proposes a generic building facade where the lock element is formed in one piece from fiber material, extends over the surface of the insulating layer in the direction of the facade cladding and exhibits a compressibility and/or flexibility aligned at least predominantly between building wall and facade cladding.

20 Claims, 3 Drawing Sheets

(51) Int. Cl.

| | |
|---|---|
| ***E04B 1/94*** | (2006.01) |
| ***E04F 13/00*** | (2006.01) |
| ***E04B 1/76*** | (2006.01) |
| ***E04B 2/30*** | (2006.01) |
| ***E04F 13/08*** | (2006.01) |
| *E04B 2/02* | (2006.01) |

(52) U.S. Cl.
CPC ..... *E04F 13/0803* (2013.01); *E04B 1/947* (2013.01); *E04B 2002/0273* (2013.01); *E04F 2290/045* (2013.01)

(56) References Cited

U.S. PATENT DOCUMENTS 6,182,407 B1 * 2/2001 Turpin ..... E04B 1/942 52/232
2002/0004130 A1 * 1/2002 Lhila ..... C09J 7/0257 428/317.1
2007/0028543 A1 * 2/2007 Lachance ..... A47G 29/126 52/317
2010/0307198 A1 * 12/2010 Yokoo ..... D04H 1/42 65/458
2011/0171456 A1 * 7/2011 Weidinger ..... B32B 5/18 428/314.8
2011/0252899 A1 * 10/2011 Felts ..... C23C 16/045 73/865.8
2012/0103723 A1 * 5/2012 Pieper ..... E04B 9/045 181/294

FOREIGN PATENT DOCUMENTS

EP 0829593 A1 3/1998
EP 2426284 A1 3/2012
GB 2296263 A 5/1996

* cited by examiner

Fig. 6
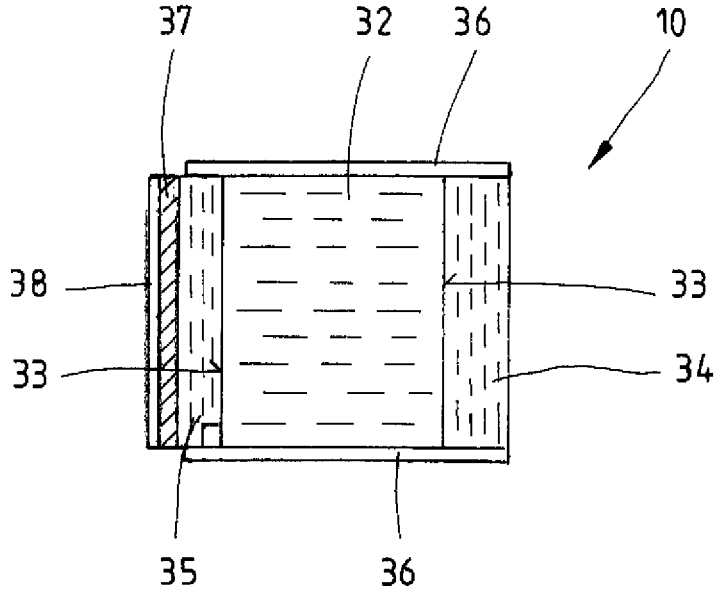
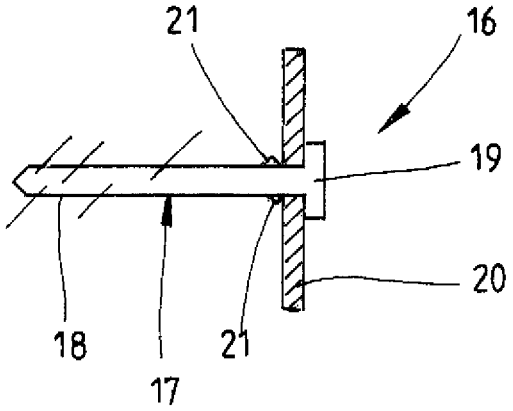
Fig. 7

BUILDING FACADE WITH LOCK ELEMENT AND LOCK ELEMENT

The invention relates to a building facade consisting of a building wall, an insulating layer comprising insulating elements, having a surface and disposed on the building wall, a facade cladding which is disposed at a distance from the building wall and from the insulating layer to form a rear ventilation gap between insulating layer and facade cladding and a lock element provided for fire protection, which is disposed between neighbouring insulating elements of the insulating layer. The invention further relates to a lock element for a building facade consisting of a substantially rectangular body.

Various building facades are known from the prior art. Basically, a distinction is made between so-called heat-insulating composite systems and rear-ventilated facades. In the heat-insulating composite systems, a heat insulation, for example consisting of individual heat-insulating panels, is adhesively bonded to the building facade and optionally connected to the building wall by means of mechanical fastening elements, for example, dowels. A rendering system is applied directly to the heat-insulating layer, which for example consists of two rendering layers, where a reinforcement fabric can be additionally introduced into the rendering layer applied directly to the heat-insulating layer in order to increase the strength of the rendering system.

The so-called rear-ventilated building facades in which an insulating layer of insulating elements is also applied to the building wall, in particular is adhesively bonded, should be distinguished from this. Possible insulating elements here for example are insulating panels made of polystyrene or of mineral fibres bound with binders. In addition, the insulating elements can be mechanically connected to the building wall by means of dowels. This is particularly necessary in higher buildings in order to absorb both the acting wind suction forces and also the weight forces where a relation between the arrangement and/or number of such mechanical fastening elements can be predefined as a function of fibre alignment and building height.

In addition, such rear-ventilated building facades have a facade cladding. This facade cladding is connected to the building wall by means of a substructure consisting of horizontally and vertically running supporting rails, where a plurality of configurations of such substructures are known which avoid heat bridges insofar as, for example, substructures of plastic or wood are used.

The facade cladding usually consists of individual flexurally rigid panel elements, for example, of highly compacted mineral fibre boards, metal panels, plastic panels or the like. These panels are adhesively bonded, and/or riveted or screwed to the substructure. However, such systems are also known in which the substructures engage in corresponding recesses of the panels so that a non-visible fastening of the panels to the substructure is provided.

Horizontal fire barriers are required in rear-ventilated building facades. This substantially applies to buildings having more than two floors. Thus, a horizontal fire barrier should be provided on every other floor in the rear ventilation gap formed between insulating layer and facade cladding. The fire barriers should be installed between the building wall and the facade cladding. In the case of an external heat insulation, installation between the insulating layer and the facade cladding is sufficient if the insulating material is dimensionally stable in case of fire and has a melting point of >1000° C. In the area of the fire barriers the substructures made of flammable materials must be configured to be completely interrupted. Furthermore, it is necessary for the size of the openings in the horizontal fire barriers to be limited overall to 100 $cm^2$ per running meter of wall. The openings can be configured as uniformly distributed individual openings or as a continuous gap. The horizontal fire barriers must be sufficiently dimensionally stable over at least 30 minutes. They should be anchored in the outer wall at intervals of <0.6 m.

The essential formal specifications for the configuration of a rear-ventilated building facade are obtained, for example, from DIN 18516-1.

An example of a generic rear-ventilating heat-insulated building facade is known from EP 1 731 685 A2. This previously known building facade comprises a building wall, an insulating layer disposed on the outer side of the building wall and a facade cladding disposed on the outer side of the insulating layer. The insulating layer is interrupted in the vertical direction by at least one substantially horizontally running fire lock. The facade cladding is supported by a support structure at a distance from the insulating layer and the fire lock in such a manner that a rear ventilating gap is provided between the facade cladding and the insulating layer with the fire lock where a flame blocking element made of a non-combustible material extending horizontally substantially over the entire width of the rear ventilation gap is provided in the rear ventilation gap in the area between the facade cladding and the fire lock, which element reduces the cross-section of the rear ventilation gap in this area in order to prevent a fire spreading from one side of the fire lock to the other side of the same via the rear ventilation gap.

It can be deduced from EP 1 731 685 A2 that the fire lock is preferably made of a polyurethane foam material and can have a fleece backing on its outer side, whereby its resistance in the case of fire is increased. The flame blocking element consists of a non-combustible material and is configured and arranged in such a manner that it reduces the flow cross-section of the rear ventilation gap in the case of fire by at least 50%. By this means spreading of flames over the rear ventilation gap into the area lying above the flame blocking element is rendered difficult or prevented. The flame blocking element preferably has a supporting structure made or metallic or ceramic profile material. In this configuration it is provided that the fire lock ends superficially flush with the insulating layer.

A disadvantage with the configuration of a rear-ventilated building facade presented hereinbefore is that in addition to the insulating layer and the lock element, here a fire lock, a further component is provided which should be arranged in the rear ventilation gap. It is furthermore disadvantageous that this usually comprises a metal element which, after its fastening can also form a heat bridge and consequently reduces the heat insulating capacity of the insulating layer.

Starting from this prior art, it is the object of the invention to further develop a building facade and a lock element in such a manner that it can be manufactured and installed in a simple and therefore cost-effective manner without additional structural elements being provided.

The solution of this formulation of the problem provides in a generic building facade that the lock element is formed in one piece from fibre material, extends over the surface of the insulating layer in the direction of the facade cladding and exhibits a compressibility and/or flexibility aligned at least predominantly between building wall and facade cladding. On the part of the lock element it is provided to solve the formulation of the problem that the substantially rectangular body of fibre material is formed in one piece and has a compressibility and/or flexibility aligned at least with respect to a body axis parallel to surfaces.

The building facade according to the invention and the lock element according to the invention are characterised in that the required fire protection lock can be formed in a particularly simple and advantageous manner in a suspended rear-ventilated facade. In addition, the fire protection lock provided according to the invention provides excellent heat insulating properties due to the lock element made of fibre material without thereby losing the suitability as a fire protection lock. The configuration of the lock element with a compressibility and/or flexibility aligned between building wall and facade cladding has the advantage that the lock element can be adjusted in a simple manner to the required distance between building wall and facade cladding in such a manner that the air gap to be provided between the surface of the lock element and the inner surface of the facade cladding still remains. As will be described further hereinafter, this is accomplished, for example, by spacer elements or by a pre-tensioning of the lock element.

According to a further feature of the invention, it is provided that the lock element is formed from mineral fibres, in particular from glass wool or rock wool fibres. These mineral fibres meet the requirements of non-combustibility. In particular in the case of rock wool fibres, it is possible to use only a small fraction of binders, for example, phenol resin, so that a substantially fire-resistant structural element is provided.

According to a further feature of the invention, it is provided that the lock element is connected to the building wall, in particular adhesively bonded, preferably by means of a mineral adhesive such as, for example, an adhesive mortar having an adhesive plastic component. In this embodiment the lock element is located in a fixed position. This fastening can be provided in addition to the clamping insertion between two neighbouring insulating elements. The use of a mineral adhesive has the advantage that this also meets high requirements for the flame resistance and fire resistance. However it is also possible that the lock element is provided on a surface, namely the surface facing the building wall, with an activatable adhesive which is activated when installing the lock element. For example, this can be accomplished by covering the activatable adhesive by means of a film which film is removed directly before installation of the lock element and releases the activated adhesive so that this can be used for connecting the lock element to the building wall. Insofar as the lock element is finally fixed in a clamping manner in the building facade between neighbouring insulating elements, it is also sufficient if the activatable adhesive is only adhesive for a certain time, i.e. the time for the positionally accurate arrangement of the lock element.

According to a further feature of the invention, it is provided that the lock element is disposed with force fit between adjacently located insulating elements. This configuration on the one hand offers the possibility of dispensing with additional adhesive and on the other hand ensures a close abutment of the neighbouring insulating elements on the lock element so that the thermal capacity of the building facade is improved.

A further development of the building facade according to the invention provides that the lock element has a coating which may contain mineral fibres and/or which expands under the action of fire at least on its surface facing the facade cladding. These comprise intumescent coatings which, for example, can comprise a mixture of a water-eliminating hydroxide and a water glass or silica sol so that at the same time as the expansion of the lock element and therefore the sealing abutment against the facade cladding, a cooling function is achieved here at the same time which significantly increases the fire resistance in this area. Such flexibility and compressibility is preferably achieved by the lock element having a fibre course substantially in a direction between building wall and facade cladding. For example, a so-called fibre lamella can be used in this respect which is cut according to the dimensions of the required lock element. Such a fibre lamella furthermore has the advantage of a high compressive strength in the direction of the surface normals of the building wall or the facade cladding. Furthermore, a foil made of for example aluminium can be used as a lining of the coating and for of the lock element per se.

According to a further feature of the invention, it is provided that the lock element is formed at least from two layers of different strengths and/or bulk densities and/or fibre orientations. Such a lock element has the advantage that the various requirements regarding the preferred direction of the compressibility and the strength can be adjusted. Thus, different compressibilities may be necessary, for example, in the area between the adjacently disposed insulating elements at right angles to the longitudinal axis of the lock element and in the area of an end face facing the facade cladding parallel to the longitudinal axis of the lock element in order to be able to adjust the positionally accurate arrangement of the lock element relative to the facade cladding here, for example, by means of a fastening and spacer element.

The different compressibilities can be provided both by different bulk densities and also by different fibre orientations. Usual bulk densities in this area lie between 30 and 90 $kg/m^3$, where lower bulk densities mean a higher compressibility and better heat insulating properties but also have the result that corresponding lock elements do not have the sufficient bending rigidity in order in particular to have a sufficient stability with a significant overhang over the insulating layer. This requisite stability can naturally be provided both by the fibre course and also by additional structural elements such as for example linings made of an aluminium foil or other foils increasing the stability of the lock element. Furthermore, the necessary compressibility can also be achieved in lock elements made of mineral fibres having a higher bulk density whereby the lock elements are milled and/or needled in partial areas with the result that the fibre composite comes undone in these areas and a higher compressibility and flexibility of the lock element is provided in these areas.

Preferably the lock element has a layer of high compressibility and/or flexibility facing the building wall. This configuration is used to be able to compensate for any unevennesses of the building wall so that extensive abutment of the lock element against the building wall, optionally with an interposed adhesive, is ensured.

According to a further feature of the invention, it is provided that at least one spacer element is located between the surface of the lock element and the facade cladding, which element preferably has a threaded section for screwing into the lock element. This spacer element is screwed into the lock element and anchored therein and ensures that the required distance is set between the surface of the lock element facing the facade cladding and the facade cladding. The spacer element usually comprises a disk-shaped panel which rests on the surface of the lock element. Due to the configuration of the spacer element, it can be provided that a compression and therefore shortening of the lock element in the axial direction is accomplished by means of different screw-in depths of the spacer element inside the lock element so that the installation position of the lock element relative to the facade cladding can be adjusted by means of the spacer element with the threaded section. Naturally it is possible to screw the spacer element through the entire lock element into the building wall so that the axial length of the lock element can be adjusted by means of the connection of the threaded section to the building wall. In this case, it has naturally proved to be advantageous to form the spacer element and in particular the threaded section from a plastic in order to avoid any heat bridges.

According to a further feature of the invention, it is provided that the spacer element consists of a material, at least in partial areas, which burns and/or melts in the case of fire so that a lock element located under pre-stress by means of the spacer element is exposed after burning or melting of the spacer element and can expand as far as the facade cladding in order to provide here a seal between building wall and facade cladding at least over a temporary time interval. This embodiment provides an alternative to a coating of the lock element which expands under the action of fire.

According to a further feature of the invention, it is provided that the lock element has a cover layer having an increased bulk density compared with the further regions of the lock element in the area of its surface facing the facade cladding. This embodiment has the advantage, in particular in conjunction with the previously described spacer elements that the pressure applied by the spacer element to the surface of the lock element over the surface having elevated bulk density is distributed over a larger area of the lock element so that a linear compression is made possible over the entire surface of the lock element. Pulling of the lock element through the spacer element in the area of the inserted spacer element is thereby largely prevented.

Usually such a cover layer can have a bulk density increased by 30 to 50% in the area of the surface. Bulk density values between 50 and 135 kg/m$^3$ can be provided here. Suitable here for example is a so-called dual density product in which by mechanical action of a mineral fibre insulating material element, a layer located in the area of the surface is achieved which has an elevated bulk density compared to the further body of the mineral fibre insulating material element.

Preferably according to a further development, the lock element has a coating on at least one of the side surfaces facing the insulating elements, whose frictional resistance is lower than the frictional resistance of the side surface. This embodiment has the advantage that in the case of fire and after elimination, for example, of the spacer element, the lock element is relaxed without losses of friction between the lock element and the neighbouring insulating elements and can therefore expand without overly great friction losses.

Alternatively the lock element can be formed as a panel element which can be bent at right angles to one of its body axes running parallel to large surfaces to form a restoring force. In this embodiment consequently a U-shaped panel element is formed where the two legs of the panel element arranged in a U shape are located substantially contiguous to one another. The lock element has a sufficient flexibility combined with a sufficient restoring force. Such a lock element is additionally fixed with a fixing element in an initial position. A possible fixing element, for example, is a banderole which disintegrates under the action of fire, that is for example, which melts away or burns, so that at the fixing element eliminated in the case of fire, the lock element attempts, due to the given restoring force, to adopt the stretched panel shape so that at least one leg of the lock element installed in a U shape is pressed by the restoring force against the inner surface of the facade cladding and here forms a fire barrier.

A further alternative embodiment of the lock element provides that the lock element is formed as a rectangle divided into two parts transversely to a body axis, where the two parts are formed displaceably along their contact surfaces. In the simplest manner the lock element which is configured to be rectangular is divided between two diametrically opposite edges into two elements having a triangular cross-section which together form the rectangle and can be installed in a rectangular shape between neighbouring insulating elements. The two parts of the lock element are fixed in this initial position where the fixing element in turn burns or melts in the case of fire so that the two parts of the lock element can be moved relative to one another along the contact surfaces and in this case, the part of the lock element arranged with its end face facing the facade cladding slips along the contact surface in the direction of the facade cladding and thereby forms a fire barrier. However it is not necessary that the two parts of the lock element are formed with the same dimensions. On the contrary it is possible that the part of the lock element moving in the direction of the facade cladding in the case of fire is configured to be substantially smaller than the part of the lock element remaining between the two insulating elements in the case of fire. In this embodiment the functional reliability is adjusted in particular through the degree of inclination of the contact surfaces forming a skew plane and/or the weight of the displaceable part of the lock element. The use of a pertinent part of the lock element having higher bulk density and therefore higher weight has proved to be advantageous where in addition, the contact surfaces between the two parts of the lock element can be formed with a frictional force reducing coating or lining.

Further features and advantages of the configuration of a building facade or a lock element according to the invention are obtained from the following description and relevant drawings. In the drawings:

FIG. 6 shows a further embodiment of a lock element for a building facade according to FIG. 1 and FIG. 7 shows a spacer element in side view.

Figure 1:
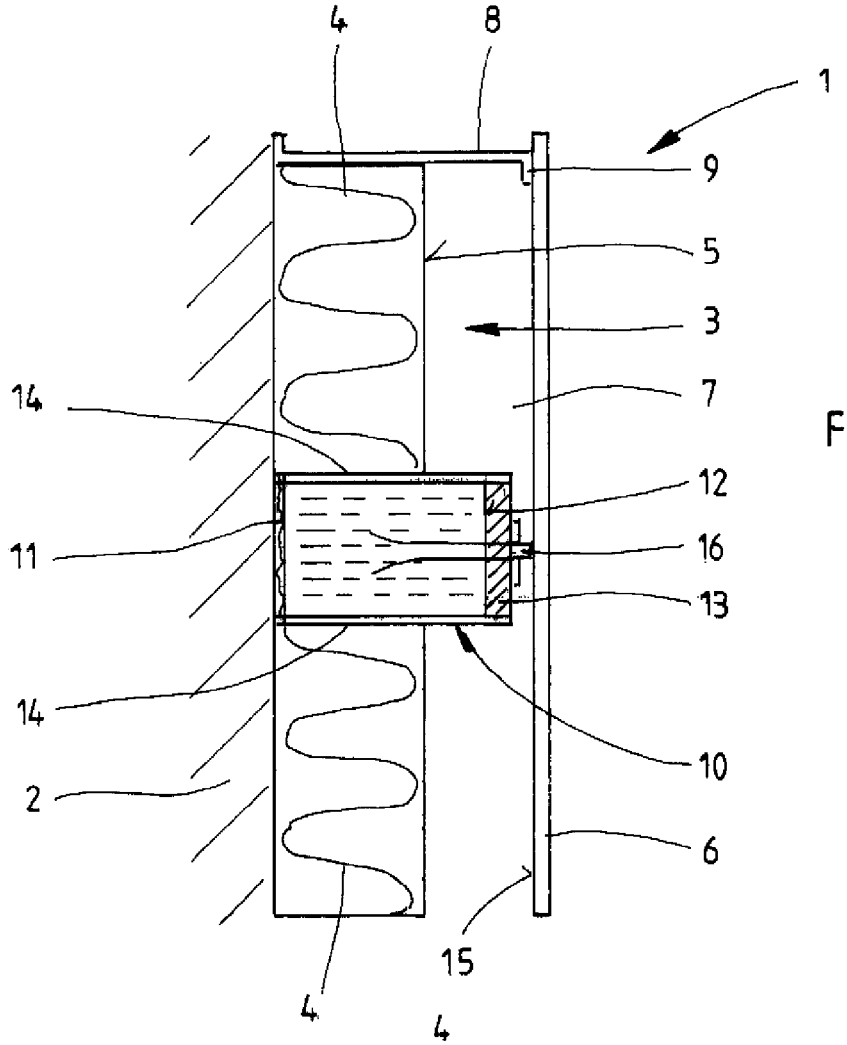
FIG. 1 shows a section of a building facade with a lock element in cutaway side view.

FIG. 1 shows a section of a building facade 1 with a building wall 2. Located on the building wall 2 is an insulating layer 3 consisting of insulating elements 4 made of mineral fibres which are bound with binders. The insulating elements 4 and therefore the insulating layer 3 form a surface 5. Located in front of the insulating layer 3 is a facade cladding 6 comprising individual panel elements not shown in detail. The facade cladding 6 is located at a distance from the insulating layer 3 forming a rear ventilation gap 7 and is connected by means of Z-shaped fastening elements 8 to the building wall 2. In this regard the fastening element 8 can be dowelled and screwed to the building wall 2 whereas the facade cladding 6 is adhesively bonded to a web 9 of the fastening element 8.

Located between two adjacently disposed insulating elements 4 is a lock element 10 which is formed from mineral fibres and extends over the surface 5 in the direction of the facade cladding 6, where the lock element 10 exhibits a compressibility and flexibility aligned between building wall 2 and facade cladding 6. The lock element 10 is adhesively bonded to the building wall 2 by means of an adhesive layer 11. The adhesive layer 11 can consist of a mineral adhesive, in particular an adhesive mortar. In the same way the insulating elements 4 can be adhesively bonded to the building wall 2 where mechanical fastening elements not shown in detail, for example, dowels with dowel plates resting on the surface 5 of the insulating elements 4 are additionally provided.

In addition, the lock element 10 is located with a force fit between the two insulating elements 4, where the lock element 10 substantially has a fibre course which extends from the building wall 2 to the facade cladding 6. On its end face 12 facing the facade cladding 6, the lock element 10 has a layer 13 formed in one piece with the lock element 10, which also consists of mineral fibres and binders but has an elevated bulk density compared with the lock element 10.

It can furthermore be identified in FIG. 1 that on its two surfaces facing the insulating elements 4, the lock element 10 has a lining 14 made of a film having low frictional resistance.

Located between the end face of the lock element 10 and the inner surface 15 of the facade cladding 6 is a spacer element 16 which is shown in detail in FIG. 7.

The spacer element 16 consists of a screw element 17 with a threaded section 18 and a head 19 located on the opposite end which has an enlarged diameter compared with the threaded section 18. The screw element 17 passes through a pressure plate 20 which in the mounted state rests on the end face of the lock element 10. At a distance consistent with the material thickness of the pressure plate 20 the screw element 17 has nipple-shaped projections so that the pressure plate 20 which can be pushed over the nipple-like projections 21 under the application of a certain force, is held in a fixed position between these projections 21 and the head 19.

The screw element 17 consists of a plastic which melts under the action of fire so that in particular under the action of fire the head 19 melts and enables a displacement of the pressure plate 20 in the axial direction of the screw element 17. In the case of a lock element 10 pre-tensioned by means of the spacer element 16, the lock element configured in such a manner can be released in the case of fire after the head 19 has melted away so that the lock element 10 moves in the direction of the inner surface 15 of the facade cladding 6.

Figure 2:
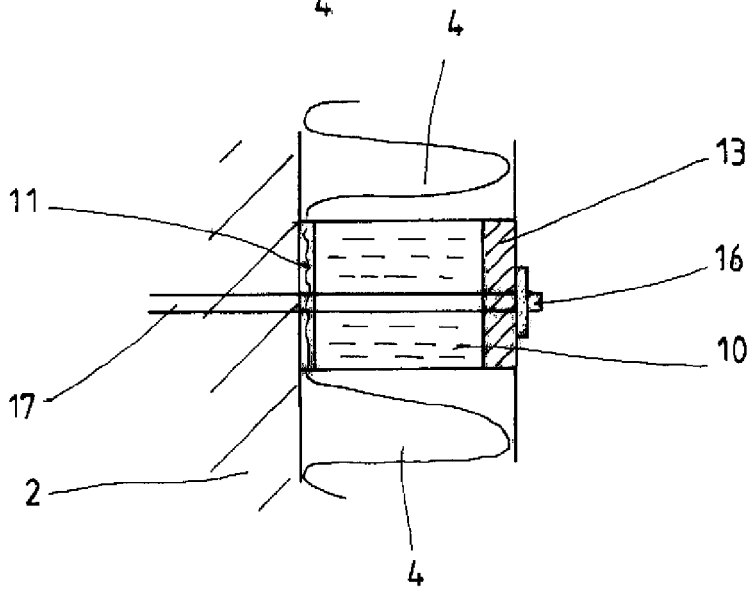
FIG. 2 shows an alternative embodiment of a lock element in a building facade according to FIG. 1.

FIG. 1 shows in this respect an embodiment in which the screw element 17 is disposed and anchored inside the lock element 10. Compared with this, FIG. 2 shows an embodiment with a spacer element 16 whose screw element 17 is anchored in the building wall 2.

FIGS. 3 to 6 show alternative embodiments of the lock element 10 and are described hereinafter.

Figure 3:
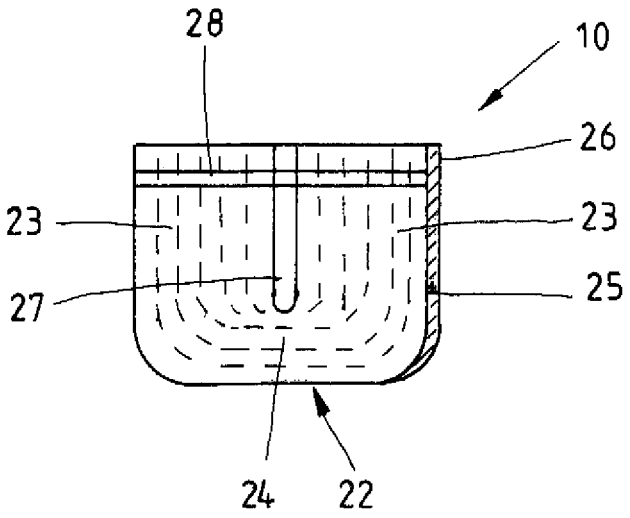
FIG. 3 shows a further alternative embodiment of a lock element for a building facade according to FIG. 1.

FIG. 3 shows a lock element 10 which is formed from a mineral fibre board which can be bent to produce a restoring force in such a manner that two legs 23 running parallel to one another and a web 24 connecting the legs are formed. On a surface 25 facing the inner surface 15 of the facade cladding 6 in the installation position, one leg 23 has a coating 26 preferably containing mineral fibres. The coating 26 expands under the action of fire at least on its surface facing towards the facade cladding. The coating 26 can be covered by a not shown lining of an aluminium foil.

In addition, a material which expands under the action of fire, in particular an intumescent material, can be provided in a cavity 27 of the lock element 10 formed between the legs 23.

In addition, FIG. 3 shows a banderole 28 which is held by the two legs 23 in the initial position and which burns and/or melts under the action of fire so that the two legs 23 are released under the action of fire and as a result of the prestressing in the area of the web 24, the leg 23 with the coating 26 is pivoted in the direction of the inner surface 15 of the facade cladding 6. Abutting against the inner surface 15 of the facade cladding 6 in such a manner, the leg 23 with the coating 26 forms a fire barrier.

Figure 4:
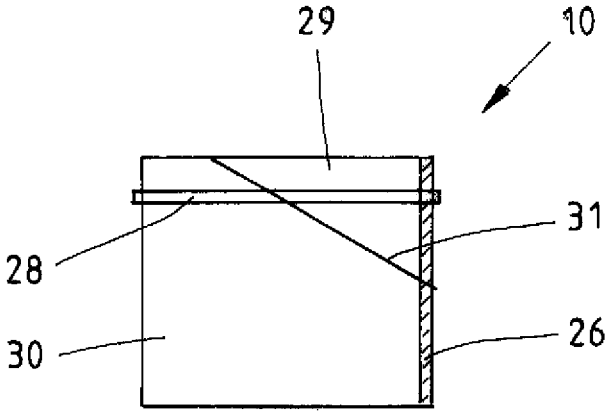
FIG. 4 shows a further embodiment of a lock element for a building facade according to FIG. 1.

An alternative embodiment of the lock element 10 is shown in FIG. 4. This embodiment of the lock element 10 consists of two parts 29 and 30 which are displaceable relative to one another along their contact surfaces 31 provided that a banderole 28 preventing displacement into the initial position forms the connection between the two parts 29 and 30. The lock element 10 according to FIG. 4 also has a coating 26 on its side surface which in the case of fire abuts at least partially against the inner surface 15 of the facade cladding 6 after displacement of the part 29 relative to the part 30. The contact surfaces 31 of the two parts 29, 30 can additionally be formed with a film which has a low friction resistance so that in the case of fire after removal of the banderole 28 the part 29 can slip in a simplified manner along the contact surface. In order to improve the movement of the part 29 relative to the part 30 of the lock element 10, it is provided that the part 29 has an increased bulk density compared with the part 30, this can also be provided, for example, by doping the pores formed between the fibres in the part 29 with a material having a high specific bulk density. The coating 26 in FIG. 4 can have the same characteristics as the coating 26 in FIG. 3 for example a lining made of a foil, especially of aluminium.

Figure 5:
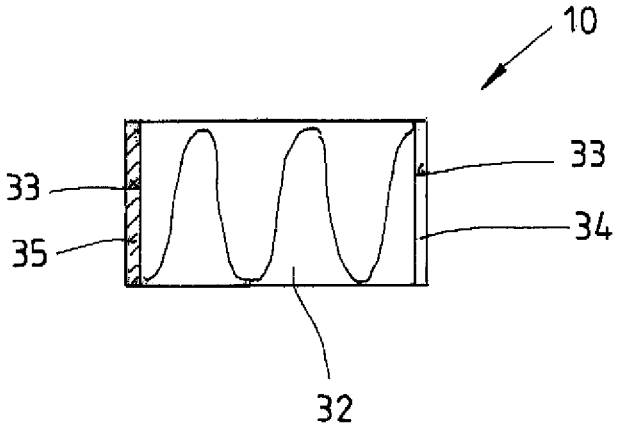
FIG. 5 shows a further embodiment of a lock element for a building facade according to FIG. 1.

FIG. 5 shows another embodiment of a lock element 10 which consists of a mineral fibre body 32. End faces 33 of the mineral fibre body 32 located diametrically opposite are formed with different layers 34, 35 where the layer 34 consists of mineral fibres and binders which layer 34 has an increased bulk density compared with the mineral fibre body 32.

The layer 35 also consists of mineral fibres and binders and is configured to be compressible or flexible so that unevennesses of the building wall 2 can be compensated over the layer 35.

Finally FIG. 6 shows a further configuration of the embodiment of the lock element according to FIG. 10. It can be seen that the mineral fibre body 32 has a fibre course in the longitudinal axial direction or in the direction of the surface normals of the two end faces 33. Compared to this, the two layers 34, 35 have a fibre course at right angles thereto, i.e. parallel to the end faces 33.

Furthermore, it can be seen that the mineral fibre body 32 has a lining 36 in the area of its two surfaces running at right angles to the end faces 33, which is formed from a friction-reducing material, in particular a film.

Finally, the lock element 10 according to FIG. 6 has a layer 37 of an adhesive in the area on the layer 35, which is covered with a film layer 38. By removal of the film layer 38 the adhesive in the layer 37 is activated and is then available for adhesion of the lock element 10 to the building wall 2.

The previously described banderoles 28 can, for example, consist of a polyethylene film. 40 to 60 kg/m$^3$ have proved advantageous for the bulk density range for the lock element 10 according to FIG. 3. In addition to the previously described films for the coatings of the lock element 10, fleece linings are also feasible in order, for example, to avoid cracking of the lock element 10, in particular in an embodiment according to FIG. 3.

The spacer element 16 of FIG. 7 can be used to fix a second layer for example made of mineral wool to the outside of an existing insulation layer to increase the insulation properties of the existing insulation in the facade area, for example in the renovation and refurbishment of existing buildings.

The invention is not restricted to the embodiments presented hereinbefore, on the contrary amendments and additions are possible without departing from the scope of protection of the invention. Furthermore, it should be noted that the lock element according to claim 16 can be configured with each individual one of the features of the preceding claims 1 to 15 whilst preserving the previously described advantages. A corresponding lock element is also part of the invention.

REFERENCE LIST

1 Building facade
2 Building wall
3 Insulating layer
4 Insulating element
5 Surface
6 Facade cladding
7 Rearventilation gap
8 Fastening element
9 Web
10 Lock element
11 Adhesive layer
12 End face
13 Layer
14 Lining
15 Inner surface
16 Spacer element
17 Screw element
18 Thread section
19 Head
20 Pressure plate
21 Projection
22 Mineral fibre plate
23 Leg
24 Web
25 Surface
26 Coating
27 Cavity
28 Banderole
29 Part
30 Part
31 Contact surface
32 Mineral fibre body
33 End face
34 Layer
35 Layer
36 Lining
37 Layer
38 Film layer

The invention claimed is:

1. A building facade consisting of a building wall, an insulating layer comprising insulating elements, having a surface and disposed on the building wall, a facade cladding which is disposed at a distance from the building wall and from the insulating layer to form a rear ventilation gap between the insulating layer and the facade cladding and a lock element provided for fire protection, which is disposed between neighboring insulating elements of the insulating layer, characterized in that the lock element is formed in one piece from fiber material, extends beyond the surface of the insulating layer in the direction of the facade cladding and exhibits a compressibility or flexibility aligned at least predominantly between the building wall and the facade cladding and in that at least one spacer element made of plastic is located between the surface of the lock element and the façade cladding.

2. The building facade according to claim 1, characterized in that the lock element is formed from mineral fibers.

3. The building façade according to claim 2, wherein the fibers are glass wool or rock wool.

4. The building facade according to claim 1 characterized in that the lock element is adhesively bonded to the building wall.

5. The building façade according to claim 4, wherein the lock element is connected to the building wall by a mineral adhesive.

6. The building façade according to claim 5, wherein the mineral adhesive is an adhesive mortar having an adhesive plastic component.

7. The building facade according to claim 1, characterized in that the lock element is disposed with force fit between adjacently located insulating elements.

8. The building facade according to claim 1, characterized in that the lock element has a coating which expands under the action of fire at least on its surface facing towards the facade cladding.

9. The building facade according to claim 1, characterized in that the lock element is located in a direction extending between the facade cladding and the building wall pre-tensioned between the facade cladding and a subsurface.

10. The building facade according to claim 1, characterized in that the spacer element has a threaded section for screwing into the lock element.

11. The building facade according to claim 1, characterized in that the lock element has a fiber course substantially in a direction between the building wall and the facade cladding.

12. The building facade according to claim 1, characterized in that the lock element is covered with a layer providing an increased bulk density to the lock element.

13. The building facade according to claim 1, characterized in that the lock element has a coating on at least one of the side surfaces facing the insulating elements, whose frictional resistance is lower than the frictional resistance of the side surface.

14. The building facade according to claim 1, characterized in that the lock element is formed as a panel element which can be bent at right angles to one of its body axes running parallel to surfaces of the lock element to form a restoring force.

15. The building facade according to claim 14, characterized in that the lock element is fixed in its initial position by means of a fixing element which releases under the action of fire.

16. The lock element for the building facade according to claim 1, consisting of a substantially rectangular body of fiber material which is formed in one piece and has a compressibility, flexibility or compressibility and flexibility aligned at least with respect to a body axis parallel to surfaces whereby one spacer element made of plastic is located at a surface.

17. The lock element according to claim 16, having a layer of an adhesive which is covered with a film layer, removable to activate the adhesive being then available for adhesion of the lock element to the building wall.

18. A building facade consisting of a building wall, an insulating layer comprising insulating elements, having a surface and disposed on the building wall, a facade cladding which is disposed at a distance from the building wall and from the insulating layer to form a rear ventilation gap between the insulating layer and the facade cladding and a lock element provided for fire protection, which is disposed between neighboring insulating elements of the insulating layer, characterized in that the lock element is formed at least from two layers of different strengths or bulk densities or fiber orientation and extends beyond the surface of the insulating layer in the direction of the facade cladding and exhibits a compressibility or flexibility aligned at least predominantly between the building wall and the facade cladding and in that at least one spacer element made of plastic is located between the surface of the lock element and the façade cladding.

19. The building facade according to claim 18, characterized in that the lock element has a layer of high compressibility or flexibility facing the building wall.

20. A building facade consisting of a building wall, an insulating layer comprising insulating elements, having a surface and disposed on the building wall, a facade cladding which is disposed at a distance from the building wall and from the insulating layer to form a rear ventilation gap between the insulating layer and the facade cladding and a lock element provided for fire protection, which is disposed between neighboring insulating elements of the insulating layer, characterized in that the lock element is formed as a rectangle divided into two parts transversely to a body axis, where the two parts are formed displaceably along their contact surfaces and in that at least one spacer element made of plastic is located between the surface of the lock element and the façade cladding.

* * * * *